US005375394A

United States Patent [19]

Heudecker

[11] Patent Number: 5,375,394

[45] Date of Patent: Dec. 27, 1994

[54] METHOD AND DEVICE FOR SEALING A BOTTLE

[75] Inventor: Gerhard Heudecker, Pentling, Germany

[73] Assignee: Krones AG Hermann Kronseder Maschinenfabrik, Neutraubling, Germany

[21] Appl. No.: 31,358

[22] Filed: Mar. 15, 1993

[30] Foreign Application Priority Data

Mar. 17, 1992 [DE] Germany ..... 4208440

[51] Int. Cl.[5] ..... B67B 3/12; B65B 7/28

[52] U.S. Cl. ..... 53/488; 53/343; 53/359; 53/368

[58] Field of Search ..... 53/488, 341, 342, 343, 53/359, 361, 362, 367, 368, 167, 306

[56] References Cited

U.S. PATENT DOCUMENTS

| | | | |
|---|---|---|---|
| 2,017,411 | 10/1935 | Kantor | 53/368 |
| 2,108,932 | 2/1938 | Segebaden et al. | 53/488 |
| 2,498,443 | 2/1950 | Naccarato et al. | 53/368 X |
| 3,075,331 | 1/1963 | Stanley | 53/367 X |
| 3,308,604 | 3/1967 | Nekola | 53/343 |
| 3,461,649 | 8/1969 | Ermer, Jr. et al. | 53/367 X |
| 3,470,667 | 10/1969 | David et al. | 53/488 |
| 3,889,451 | 6/1975 | Burkhardt | 53/342 |
| 4,205,502 | 6/1980 | Ahlers | 53/367 X |
| 5,150,558 | 9/1992 | Bernhard | 53/359 X |

FOREIGN PATENT DOCUMENTS

| | | |
|---|---|---|
| 2147770 | 3/1972 | Germany . |
| 4115285 | 1/1992 | Germany . |

*Primary Examiner*—Horace M. Culver
*Attorney, Agent, or Firm*—Finnegan, Henderson, Farabow, Garrett & Dunner

[57] ABSTRACT

Method for sealing a bottle by deforming a crown cap put on a bottle mouth, in which a holding elmement positions the crown cap on the bottle mouth during a positioning phase. In a sealing phase the crown cap is inserted in a sealing end of the sealer through a conical inlet region, is deformed thereby and fixed on the bottle. After deformation of the crown cap, a rejecting element rejects the crown cap from the sealing end during a rejection phase. To seal the bottle during the sealing phase almost without any head-pressure and in a simple way without breaking the bottle, the holding element holds the crown cap during the positioning and sealing phase basically without any pressure on the bottle mouth and during the following sealing phase the rejecting element is biased for rejecting the crown cap during the rejection phase.

30 Claims, 3 Drawing Sheets

METHOD AND DEVICE FOR SEALING A BOTTLE

The invention relates to a method and a device for sealing a bottle by deforming a crown cap put on a bottle mouth, wherein in a positioning phase a holding element positions the crown cap on the bottle mouth, wherein in a sealing phase the crown cap is inserted through a conical inlet region into a sealing end of a sealer, and is thereby deformed and fixed on the bottle, and wherein in a rejection phase a rejecting element rejects the crown cap from the sealing end after the crown cap is deformed.

Such a method and device are known from DE-OS 4115285 or from DE-OS 2147770.

A ram-like holding-down clamp and a spring-loaded sealing element are arranged in a sealing housing in DE-OS 4115285. In a positioning phase, the holding-down clamp holds the crown cap, and a bottle located on a carrier is positioned relative to the crown cap and a centering element. Before and during the sealing phase the sealing element is pressed on the holding-down clamp and exerts a high pressure, the so-called head pressure, on the crown cap and thus on the bottle. After termination of the sealing phase the bottle is finally rejected from the sealer.

In DE-OS 2147770 a holding-down clamp is movably supported in a press-down element and loaded by a spring. In the positioning phase, the holding-down clamp holds the crown cap on the bottle mouth. Before the sealing phase, the holding-down clamp is fixed relative to the press-down element and both are pressed into the sealer by the relative movement of sealer and bottle. By this pressure load of the press-down element by means of a spring, a high head pressure is exerted on the crown cap. Upon termination of the sealing phase, the bottle is rejected from the sealer.

A disadvantage in the devices of these references is, that the pressure exerted by the sealing element and the press-down element during the sealing phase is usually relatively high (150 kp). The deformation force which is approximately equally high adds to this force during the sealing phase, so that during this phase the entire force acting on the bottle is approximately 300 kp. The holding devices thus have to be dimensioned correspondingly to receive such a great force. Furthermore, the chance that a bottle breaks is severely increased. Based on the high forces, the wear of the holding device for the bottles and of the sealer is relatively high. A sealing material inserted into the crown cap can easily be damaged or completely destroyed due to the high pressure between the bottle mouth and the crown cap. Therefore, a tight closing of the bottle is not always guaranteed, so that the liquid in the bottle may degas or air may penetrate into the bottle, which influences the perishability of the liquid in the bottle.

Thus, the purpose of the invention is to improve a method and a device for sealing a bottle of the above mentioned kind, so that with an essentially reduced pressure and during the sealing phase with almost no head pressure a secure sealing of the bottle is achieved in a simple way and in which a breaking of the bottle is avoided.

This object is achieved in a method for sealing a bottle by deforming a crown cap put on a bottle mouth, wherein during a positioning phase a holding element positions the crown cap on the bottle mouth, during a sealing phase the crown cap is inserted through a conical inlet region into a sealing end of a sealer, is thereby deformed and fixed on the bottle, and wherein in a rejecting phase a rejecting element rejects the crown cap from the sealing end after deformation of said crown cap, in that the holding element during the positioning and sealing phase keeps the crown cap essentially without pressure on the bottle mouth and the rejecting element for rejecting the crown cap during a biasing phase following the sealing phase is biased in the rejection phase.

According to the invention, the crown cap is held on the bottle mouth essentially without pressure during the positioning phase in which the crown cap is put on a bottle and in which the bottle is possibly inserted into the conical inlet region, and also during the sealing phase, i.e. during the deformation of he crown cap to be fixed on the bottle. Only after termination or shortly before the termination of the sealing phase is the rejecting element biased. This rejecting element almost entirely rejects the crown cap out of the sealer during the rejection phase. Since the bias of the rejecting element and the forces occurring during the sealing phase are essentially exerted consecutively on the crown cap, the higher force is not provided by the sum of these two forces, but corresponds only to the maximum sealing or rejecting force, respectively.

In contrast to the prior art, the maximum force is essentially divided in half. Correspondingly, the holding device carrying the bottles during the sealing process, may be created more simple and cheaper. Since the force acting on the bottles is severely decreased in the invention, bottle fracture does not occur so often. The forces occurring in the sealer are also severely decreased, so that wear does not occur so often. The sealing material inserted in the crown cap is subjected to minor loads by the essentially presure-less holding of the crown cap on the bottle mouth, so that the bottles are securely and tightly sealed. Problems with degasing of the filled-in liquid, air penetration or shortened perishability are almost entirely prevented.

To carry out the method, holding and rejecting elements are movably supported in the sealer and loaded with force in a direction towards the sealer end. In order to hold the crown cap essentially pressure-less on the bottle mouth, the holding element is only loaded with low force in comparison to the rejecting element. Since the holding element only engages with the rejecting element only essentially after deformation of the crown cap in the sealer, the two elements are only commonly movable in the biasing phase opposite to their load with force load.

The bias of the rejecting element can also be performed by a curve roller connected to the rejecting element and by a respective guiding curve, as it is known for bottle fillers, bottle sealers or the like. In an advantageous embodiment, the bottle and the sealer move relative to one another and bias the rejecting element during the biasing phase. In this case, the rejecting element is directly biased by the relative movement of the bottle and by the engagement of the bottle mouth with the holding element.

Since the sealing phase and biasing phase essentially follow each other, it is advantageously possible by the invention, that the maximum bias of the rejecting element is smaller than a maximum sealing force occurring during the sealing phase.

During the sealing phase the rim of the crown cap is crimped in a simple manner at the sealing end, wherein only the frictional and crimping forces occurring during this phase occur. In order to simplify the holding device and the guide of the bottles, it is of advantage if the sealer with the holding element and rejecting element moves in direction towards the bottle mouth for sealing the bottle. The bottles are for example put on a bottle plate, arranged opposite the sealer. The sealer is moved up and down in a known manner by curve rollers and respective guide curves, by means of a pneumatic or hydraulic bias or the like.

To achieve a correct positioning of the crown cap on the bottle mouth, it is of advantage, if the holding element holds the crown cap in ready position. For this purpose, a permanent magnet may be disposed in the holding end of the holding element.

In a simple embodiment of the invention, the holding element presses directly against the rejecting element in the biasing phase and biases it. In this case, the holding element and rejecting element are disposed in the sealer essentially one after the other. During the positioning and sealing phase, basically only the holding element is displaced in the sealer, while in the biasing phase the Holding element and the rejecting element are displaced.

In an embodiment of the invention, a small force bias of the holding element in direction towards the bottle mouth is performed by means of a holding spring element. It can for example be disposed between the holding element and the rejecting element, so that the holding spring element is compressed at least during the sealing phase by the movement of the holding element, by means of which the rejecting element is biased.

In a simple embodiment in this connection, a rejecting spring element is disposed in the sealer, which biases the rejecting element in direction towards the holding element.

According to a further embodiment of the invention the holding spring element is compressed as long as it engages the rejecting element in the biasing phase and biases it against the force of the rejecting spring element. The spring constant of the holding spring element is essentially smaller than the spring constant of the rejecting spring element.

The force necessary for rejecting the closed bottle from the sealer is in a simple way determined in that after termination of the biasing phase, the rejecting element engages at a rear wall opposite of the bottle mouth of a sealing housing. The holding element and the rejecting element are insertable into the sealer, so that the rejecting element contacts the rear wall. This results in a very small constructional height of the sealer.

The solutions proposed according to the invention and advantageous embodiments thereof are now described under reference of the FIGURES.

Figure 1:
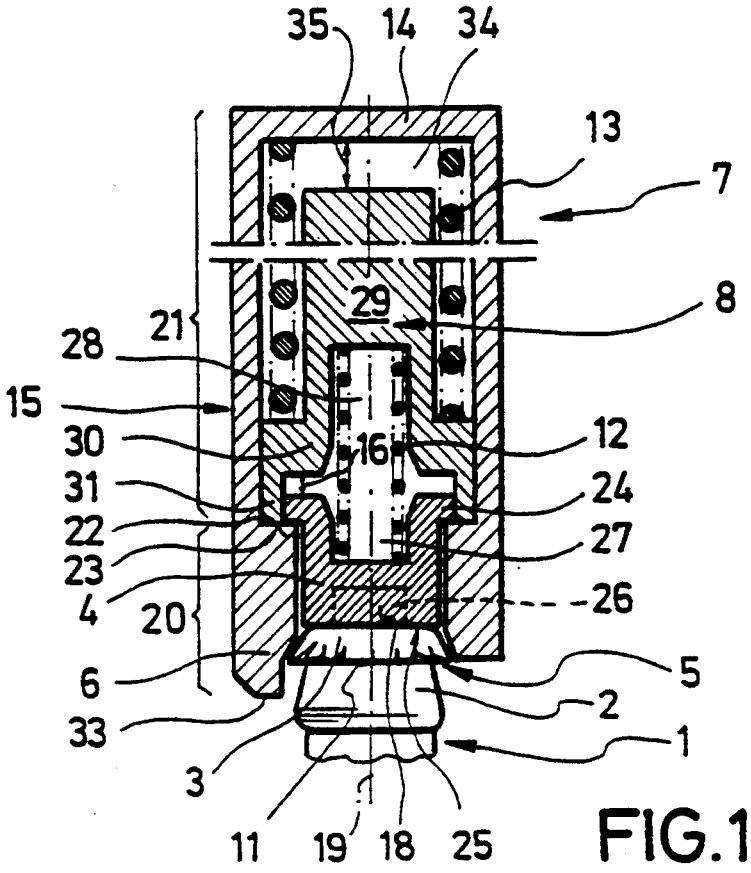
FIG. 1 shows a sealer according to the invention in positioning phase.

In FIG. 1 a single sealer 7 for sealing a bottle 1 is shown. In a known manner, a plurality of respective sealers may be rotatably arranged circularly and around the center of the circle, wherein the bottles 1 are handed over by an inlet star wheel on the bottle plates or similar supporting means for the bottles.

The sealer 7 has an essentially cylindrical sealing housing 15. It is sealed opposite to bottle 1 by a rear wall 14. The housing has a first section 20 and a second section 21 in the longitudinal direction of the housing 15. In the first section, a holding element 4 is arranged and in the second section a rejecting element 8 is arranged.

The transition region 22 between the first and second section is formed as a circumferential shoulder 23, wherein the first section 20 has a smaller inner diameter than the second section 21.

The holding element 4 is essentially formed cylindrically, wherein its outer diameter is a bit smaller than the inner diameter of the first section 20. The lower holding end 25 of the holding element 4 engages with an upper surface 18 of a crown cap 3. This crown cap has an outwardly projecting rim 11, removably contacting an inlet region 5 of a sealing end 6 of the sealer 7 associated to the bottle 1 and is positioned in this manner.

At one side of the bottle 1, the sealing end 6 comprises a stop 33, connected to the inlet region 5 in direction of the longitudinal axis 19.

Between the holding element 4 and the rejecting element 8 a holding spring 12 is disposed in recesses 27 and 28, respectively. The recess 27 is concentrically disposed in the holding element 4 and the recess 28 is concentrically disposed in the rejecting element 8, symmetrical with to the longitudinal axis 19. The open end of the recess 27 is surrounded by a radially extending flange 24. This flange contacts the circumferential shoulder 23 in the positioning phase shown in FIG. 1. The recess 28 of the rejecting element 8 also has a radially extending flange 30 at its open end, to which a sleeve 31 is connected disposed concentrically to the longitudinal axis 19. The free end of this sleeve contacts the circumferential shoulder 23.

The outer diameter of the radial flange 24 of the holding element 4 is somewhat smaller than the inner diameter of the sleeve 31. Its outer diameter is somewhat smaller than the sleeves inner diameter of the second section 21 of the sealing housing 15. The radial flange 30 of the rejecting element 8 and the holding element 4 are located opposite each other at a distance 16. The outer diameter of the cylindrical body 29 of rejecting element 8 is approximately equal to the outer diameter of the holding element 4 supported in the first section of the sealer 7. The recesses 27 and 28, respectively, each comprise at their open end an expansion conically extending outwardly.

Between the radial flange 30 and the rear wall 14, a spring 13 is disposed concentrically of body 29. It biases the rejecting element 8 in direction towards the holding element 4. The rejecting element 8 is disposed at a distance 35 from the rear wall 14, so that a space 34 is formed.

A permanent magnet 26 is disposed even with the front face of the holding end 25 of the holding element 4 for holding the crown cap 3 in the positioning phase.

Figure 2:
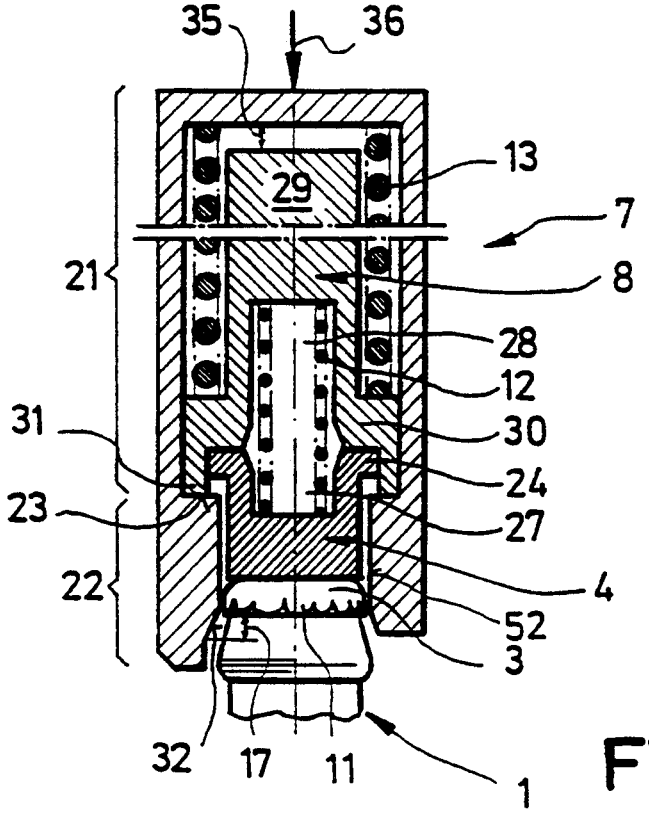
FIG. 2 shows the sealer in its sealing phase

In FIG. 2, the sealer is shown before the start of the biasing phase. The reference numerals correspond to those of FIG. 1, so that they are only partially mentioned.

By moving the sealer 7 in direction 36, the crown cap 3 is inserted along the conical surface 32 of the inlet region 5. The conical surface 32 can also be rounded-off. It forms a sealing cone and merges into a cylindrical surface 52 which forms the inner diameter of the first section 20 of the sealer 7. The holding element 4 is moved correspondingly in direction towards the rejecting element 8. The radial flange 24 of the holding element 4 moves off the circumferential shoulder 23 and engages with the radial flange 30 of the rejecting element 8. The distance 16 shown in FIG. 1 between the radial flange 24 and the radial flange 30 basically corresponds to the height 17 of the conical surface 32, so that the rim 11 of the crown cap 3 is essentially crimped by the conical surface 32 in direction towards the bottle 1, but does, however, not completely penetrate into the cylindrical surface 52.

The spring 12 in recesses 27 and 28 is partially compressed thereby, whereas the spring 13 is formed in a manner, that the distance 35 between the rejecting element 8 and the rear wall 14 in FIG. 1 and FIG. 2 is equal.

Figure 3:
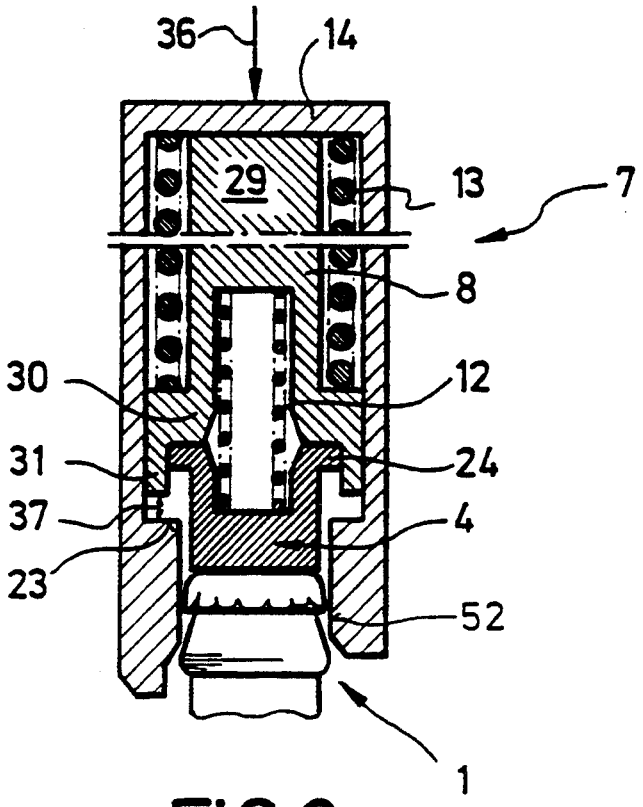
FIG. 3 shows the sealer at the end of its biasing phase.

In FIG. 3 the sealer is shown at the time of termination of the biasing phase. The same components are also characterized by the same reference numerals.

If the sealer 7 is further moved in direction 36, the clamped cap 3 moves the holding element 4 together with the rejecting element 8 upward into engagement with the rear wall 14. The sleeve 31 rising off at a distance 37 from the circumferential shoulder 23. The spring 12 as well as spring 13 are compressed in respect to that shown FIG. 1. The crown cap 3 is now completely located within the cylindrical surface 52 and is completely deformed.

Figure 4:
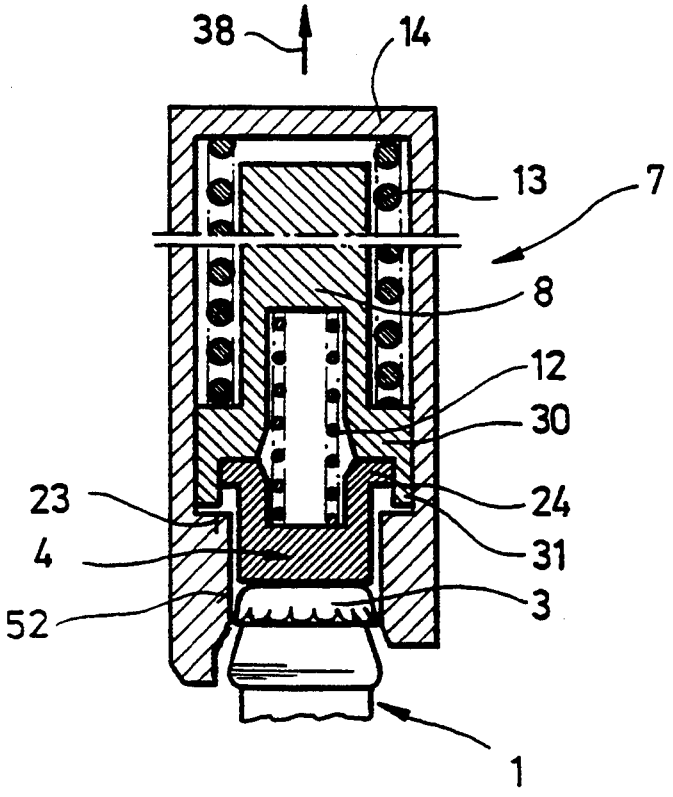
FIG. 4 shows the sealer during its rejection phase.

In FIG. 4 the sealer 7 is moved away from the bottle 1 in direction 38. The rejecting element 8 is moved to a point at a distance from the rear wall 14, where the sleeve 31 does not quite engage with the circumferential shoulder 23. However, the radial flange 24 of the holding element 4 and the radial flange 30 of the rejecting element 8 are still in engagement. The rim 11 of the crown cap 3 is now located in a transition region between the cylindrical surface 52 and the conical surface 32.

Figure 5:
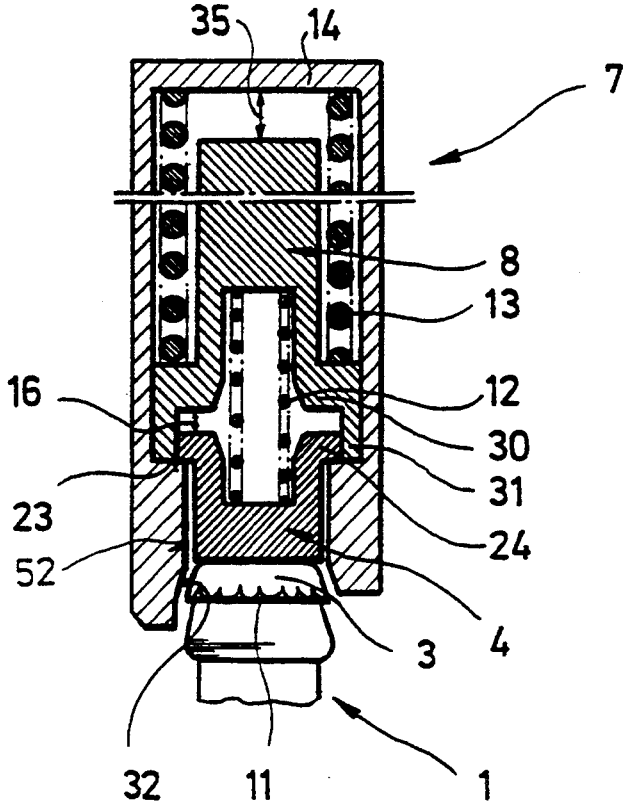
FIG. 5 shows the sealer after termination of the rejection phase.

In FIG. 5, the sealer 7 is shown in a position after termination of the sealing process corresponding to FIG. 1. The crown cap 3 is now fixed in the bottle 1 by deformation.

The radial flange 24 of holding element 4 as well as the sleeve 31 of rejecting element 8 are in engagement with the circumferential shoulder 23. The radial flanges of the holding element and the rejecting element 8 are disposed at a distance 16 from each other. The rejecting element 8 is disposed at a distance 35 from the rear wall 14 and the springs 12 and 13 are in the condition shown in FIG. 1.

The crown cap 3 is arranged in the region of the conical surface 32, wherein the rim 11 does not engage the conical surface anymore and is thus completely rejected.

Figure 6:
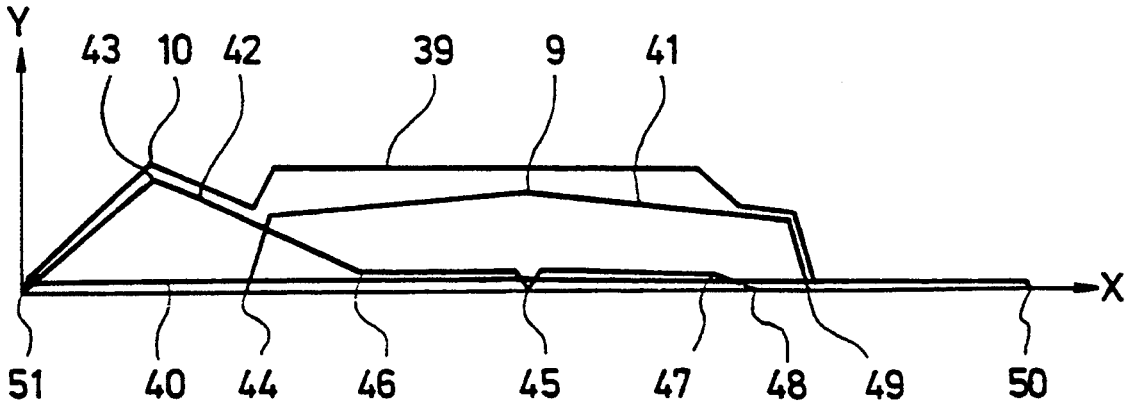
FIG. 6 shows a force-path-diagram for describing the method according to the invention.

In FIG. 6, a force-path-diagram is shown. The path of the sealer 7 is shown on the x-axis and the force acting on the bottle 1 is shown on the y-axis. The curve 39 represents the sum of the forces occurring by means of curves 40, 41 and 42. The curve 40 corresponds to the force generated by the spring 12 associated to the rejecting element 8. The curve 42 corresponds to the frictional force and deformation force generated during the movement of the crown cap on the sealer 7.

During the start 51, the individual forces and thus the entire force is still zero, which corresponds to the condition shown in FIG. 1. The spring 12 having a small spring constant is now compressed, whereby the resetting force 40 of approx. 10 kp results. This force is maintained during the entire sealing process according to FIG. 2 to 5, wherein the condition shown in FIG. 5 corresponds to the end point 50 of the curve 40.

All forces described, act on the crown cap and thus on the bottle.

When moving the crown cap through the conical inlet region 5 of the sealer 7, the frictional force 42 rises to its maximum value 43. At this position, the rim 11 of the crown cap is crimped in a manner, that the following frictional force decreases until the final deformation of the crown cap at point 46. The maximum 43 of the frictional force 42 corresponds to the maximum 10 of the sum of the force 39.

If the holding element 4 is engaged with the rejecting element 8 according to FIG. 2, the resetting force 41 of the spring 13 is generated after the starting point 44 in case the sealer is further moved in direction 36. This resetting force adds to the resetting force 40 and the frictional force 42 to establish the sum force 39.

At the end of the biasing phase shown in FIG. 3, the moving direction 36 of the sealer 7 is reversed to moving direction 38. In FIG. 6 this corresponds to the reversing point 45, or to the maximum 9, i.e. the maximum bias. As can be clearly seen in FIG. 6, the maximum bias 9 is smaller than the maximum sealing force 10. Then the resetting force 41 decreases, wherein the condition shown in FIG. 4 corresponds to the end 48 of the frictional force 42. In this case, the rim 11 of the crown cap 3 does not engage the inlet region of the sealer 7 anymore, so that no more frictional forces occur.

Then the spring 13 of the rejecting element 8 is further relieved, until the sleeve 31 engages the circumferential shoulder 23 again, which corresponds to the resetting force 41 acting on the crown cap in FIG. 6. The remaining rest of the diagram between points 49 and 50 basically corresponds to lowering the holding element 4 until its rim flange 24 engages the circumferential shoulder 23.

By means of the force-path-diagram it can clearly be seen, that the maximum force 10 acting on the crown cap basically corresponds to the maximum frictional force 43. That means that the crown cap is basically kept without any pressure on the bottle mouth by means of the holding element. Only the relatively small resetting force 40 is additionally exerted by means of the spring 12 as a so-called head pressure. Only after the frictional force during the sealing phase has severely decreased, the total force acting on the bottle is increased again by biasing the rejecting element. The maximum bias 9 is quite smaller than the maximum sealing force 10. Also the sum of the forces is smaller or equal to the maximum sealing force 10.

The distance between the starting point 51 and the reversing point 45 is approx. 9 mm in the shown embodiment. The maximum sealing force 10 is approx. 150 kp. In contrast to the previously known solutions, the maximum bias 9 and the maximum sealing force 10 are not added up by putting the sealing phase and the biasing phase after one another, so that an essentially smaller force acts on the bottle during the sealing process.

I claim:

1. In a method for sealing a bottle with a crown cap by deforming a crown cap around a mouth of the bottle, wherein during a positioning phase a crown cap is positioned with respect to a bottle mouth, during a sealing phase the crown cap is moved past a conical surface in a sealing end of a sealer by a sealing force acting on the sealer to deform and fix the cap on the bottle, and during an ejecting phase an ejecting element ejects the deformed crown cap from the sealing end with an ejecting force, the improvement comprising during the positioning and sealing phases, the crown cap is held by a holding element essentially without any pressure being applied to the bottle mouth by the crown cap and subsequently in a biasing phase, following the sealing phase, the ejecting element is biased into a position for subsequent ejection of the deformed crown cap during the ejecting phase.

2. The method of claim 1, wherein in the biasing phase, the bottle and the sealer move relative to one another to bias the ejecting element into said position.

3. The method of claim 1, wherein the maximum ejecting force of the ejecting element is smaller than a maximum sealing force applied during the sealing phase.

4. The method of claim 1, wherein the crown cap has a rim that is crimped in the sealing end of the sealer during the sealing phase.

5. The method of claim 1, wherein during the sealing phase the sealer together with the holding element and the rejecting element move toward the bottle mouth.

6. The method of claim 1, wherein the holding element holds the crown cap in a ready position before the positioning phase.

7. The method of claim 1, wherein the biasing phase is initiated shortly before termination of the sealing phase.

8. The method of claim 1, wherein the holding element presses against the ejecting element during the biasing phase to bias it into said position.

9. The method of claim 1, including a holding spring element that biases the holding element with force in a direction acting towards the bottle mouth.

10. The method of claim 9, wherein the holding element compresses the holding spring element at least during the sealing phase to bias it towards the bottle.

11. The method of claim 1, including an ejecting spring element that biases the ejecting element with force in a direction acting towards the holding element.

12. The method of claim 1, wherein after termination of the biasing phase, the ejecting element engages a rear wall of the sealer located opposite the bottle mouth.

13. In a sealer for sealing a bottle by deforming a crown cap around the mouth of the bottle, said sealer having a sealing end for receiving a bottle mouth and an ejecting element movably supported in the sealer and biased by biasing means in a direction towards the sealing end, whereby movement of the sealer towards the bottle mouth forces the crown cap up into the sealing end of the sealer to deform it and against the bias of the ejecting means for subsequent ejection of the cap from the sealer, the improvement comprising a holding element movably supported in the sealer between its sealing end and the ejecting element for limited movement relative to the sealer and the ejecting element for positioning and holding the crown cap during its deformation and biasing means for biasing the holding element in a direction towards the sealing end, said holding element biasing means biasing the holding element with a lower force than the biasing means for the ejecting element, whereby as the sealer moves towards the bottle mouth, the crown cap during an initial deformation stage first engages only the holding element as it moves up into the sealing end and moves the element up against its biasing means relative to the sealer and the ejecting element until the holding element engages the ejecting element and then during a final deformation stage moves both the holding element and ejecting element together relative to the sealer against the bias of the biasing means for the ejecting element and whereby as the sealer is moved away from the bottle, the ejecting element biasing means and the holding element biasing means eject the crown cap, now deformed around the mouth of a bottle, out of the sealing end of the sealer.

14. The sealer of claim 13, wherein the sealer comprises an essentially cylindrical sealer housing.

15. The sealer of claim 14, wherein the holding and ejecting elements are arranged coaxially in the cylindrical sealer housing.

16. The sealer of claim 15, wherein the sealer housing comprises two sections along its longitudinal axis, the holding element being movably supported in the first section and the ejecting element being movably supported in the second section.

17. The sealer of claim 16, wherein the transition between the first and the second sections is formed as a radially dimensioned circumferential shoulder.

18. The sealer of claim 17, wherein the holding element has a radial flange for engagement of the circumferential shoulder to limit the lower end of the path of movement of the holding element.

19. The sealer of claim 18, wherein the holding element extends between the circumferential shoulder and a conical surface at the sealing end of the sealer.

20. The sealer of claim 19, wherein the holding element has a permanent magnet at its lower end for holding a crown cap to the element.

21. The sealer of claim 20, wherein the biasing means for the holding element comprises a holding spring between the holding element and the ejecting element.

22. The sealer of claim 21, wherein ends of the holding and ejecting element facing each other each have an essentially cylindrical recess for holding the holding spring element.

23. The sealer of claim 22, wherein the cylindrical recesses have the same diameter and are coaxial with each other and the longitudinal axis of the sealer.

24. The sealer of claim 23, wherein the rejecting element is a cylindrical body and the cylindrical recess therein is surrounded by a radial flange having an outer diameter essentially corresponding to the inner diameter of the second section of the sealer housing.

25. The sealer of claim 24, wherein the second section of the sealer is sealed at its end opposite from the sealing end of the sealer by a rear wall and the biasing means for the ejecting element comprises an ejecting spring element supported between the rear wall and the radial flange.

26. The sealer of claim 25, wherein a sleeve is arranged extending along the longitudinal axis of the sealer at the radial flange of the ejecting element.

27. The sealer of claim 26, wherein the outer diameter of the sleeve is approximately equal to the inner diameter of the second section of the sealer and the inner diameter of the sleeve is approximately equal to the outer diameter of the radial flange of the holding element.

28. The sealer of claim 27, wherein the width of the radial flange of the ejecting element is approximately equal to the width of the radial flange of the holding element.

29. The sealer of claim 28, wherein the distance between the radial flanges of the holding element and the ejecting element essentially corresponds to the height of the conical surface at the sealing end of the sealer.

30. The sealer of claim 13, wherein the sealing end of the sealer has a stop on one side projecting vertically in a direction towards the bottle mouth.

* * * * *